US012760482B2

(12) United States Patent
Wu

(10) Patent No.: US 12,760,482 B2
(45) Date of Patent: Oct. 13, 2026

(54) DETERRENT MAT WITH SPIKES

(71) Applicant: Yiwu Beixin Technology Co., Ltd., Zhanjiang (CN)

(72) Inventor: Xian Wu, Zhanjiang (CN)

(73) Assignee: Yiwu Beixin Technology Co., Ltd., Zhanjiang (CN)

( * ) Notice: Subject to any disclaimer, the term of this patent is extended or adjusted under 35 U.S.C. 154(b) by 266 days.

(21) Appl. No.: 18/825,208

(22) Filed: Sep. 5, 2024

(65) Prior Publication Data

US 2026/0035869 A1 Feb. 5, 2026

(30) Foreign Application Priority Data

Jul. 30, 2024 (CN) ..... 202421832464.4

(51) Int. Cl.
*E01F 13/12* (2006.01)

(52) U.S. Cl.
CPC ..... *E01F 13/12* (2013.01)

(58) Field of Classification Search
CPC ..... E01F 13/12
USPC ..... 404/6
See application file for complete search history.

(56) References Cited

U.S. PATENT DOCUMENTS 3,407,550 A * 10/1968 Shaw ..... A01M 29/32 256/11
3,456,920 A * 7/1969 Elvington ..... E01F 13/12 404/6
4,473,948 A * 10/1984 Chadwick ..... E01F 13/12 404/6
5,322,385 A * 6/1994 Reisman ..... E01F 9/70 404/6
5,482,397 A * 1/1996 Soleau ..... E01F 13/12 404/6
6,312,189 B1 * 11/2001 Marphetia ..... E01F 13/12 404/6
6,758,628 B1 * 7/2004 Curry, Jr. ..... E01F 13/12 404/9
7,040,058 B2 5/2006 Finkelstein
7,186,052 B2 * 3/2007 Rom ..... B60R 25/09 404/6
2006/0083587 A1 * 4/2006 Marphetia ..... E01F 13/12 404/6
2011/0041420 A1 2/2011 Donoho
(Continued)

FOREIGN PATENT DOCUMENTS

CN 104762896 A * 7/2015 ..... E01F 13/123

*Primary Examiner* — Raymond W Addie

(57) ABSTRACT

The present disclosure provides a deterrent mat with spikes, which includes a base and a spike assembly. One end of the spike assembly is connected to the base and another end extends to a direction away from the base. The spike assembly at least includes a plurality of first deterrent spikes and a plurality of second deterrent spikes, and the first deterrent spikes and the second deterrent spikes are arranged on a same side. A height of the first deterrent spikes is less than that of the second deterrent spikes, and the first deterrent spikes and the second deterrent spikes are arranged alternately. By staggering the first deterrent spikes and the second deterrent spikes of different heights, the discomfort of animals during their climbing and staying may be effectively increased, thereby improving deterrent effects. The deterrent mat with spikes is simple structured and has good deterrent effects.

14 Claims, 3 Drawing Sheets

(56) References Cited

U.S. PATENT DOCUMENTS

| | | | |
|---|---|---|---|
| 2014/0144391 | A1 | 5/2014 | Ashworth |
| 2018/0098533 | A1 | 4/2018 | Donoho |

* cited by examiner

DETERRENT MAT WITH SPIKES

CROSS REFERENCE TO RELATED APPLICATIONS

This application claims priority benefits to Chinese Patent Application No. 2024218324644, filed on Jul. 30, 2024, the contents of which are incorporated herein by reference.

TECHNICAL FIELD

The present disclosure relates to the technical field of deterrent tools, and particularly to a deterrent mat with spikes.

BACKGROUND

To protect people's safety and property and prevent animals from entering yards or wandering in places such as fences, deterrent tools such as spikes are usually installed there to increase discomfort of the animals when they land or nest. Therefore, the purpose of deterring these animals is achieved.

SUMMARY

The present disclosure provides a deterrent mat with spikes. The deterrent mat with spikes includes a base and a spike assembly. One end of the spike assembly is connected to the base and another end extends to a direction away from the base. The spike assembly at least includes a plurality of first deterrent spikes and a plurality of second deterrent spikes, the plurality of first deterrent spikes and the plurality of second deterrent spikes are arranged on a same side, a height of the plurality of first deterrent spikes is less than that of the plurality of second deterrent spikes, and the plurality of first deterrent spikes and the plurality of second deterrent spikes are arranged alternately.

BRIEF DESCRIPTION OF THE DRAWINGS

The description and drawings that constitute a part of the present disclosure are provided for a further understanding of the present disclosure. The illustrative embodiments and their descriptions are provided for explanation but do not constitute improper limitations on the present disclosure.

DETAILED WAY

Figure 1:
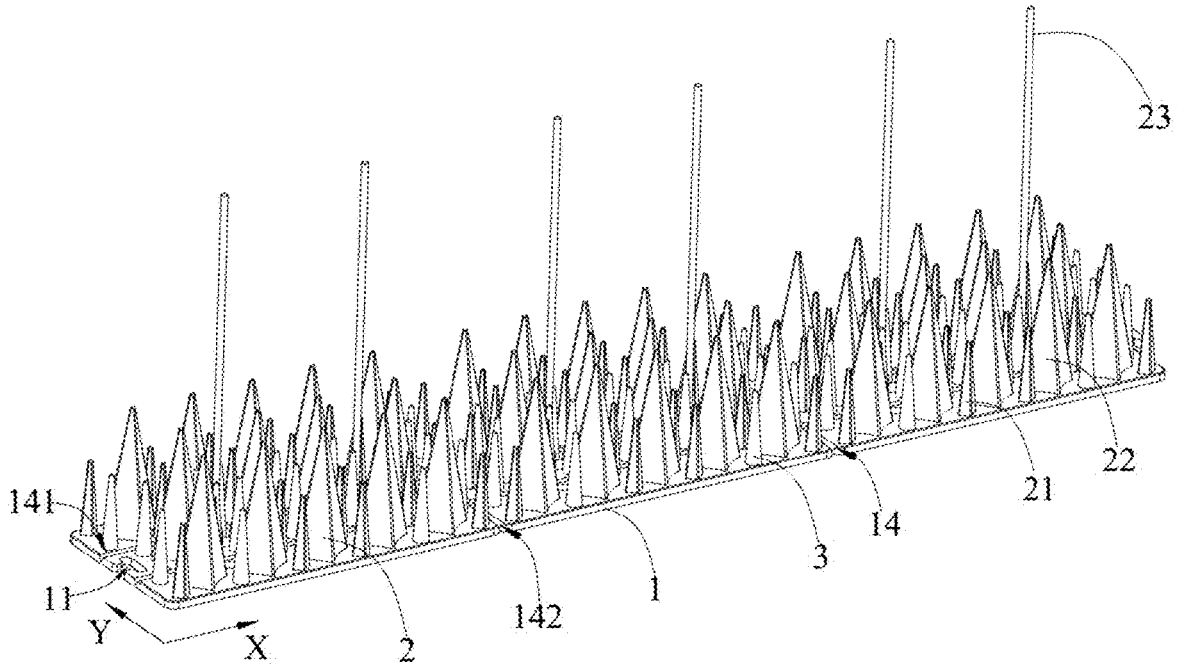
FIG. 1 is an overall schematic structural view of a deterrent mat with spikes according to an embodiment of the present disclosure.
Figure 2:
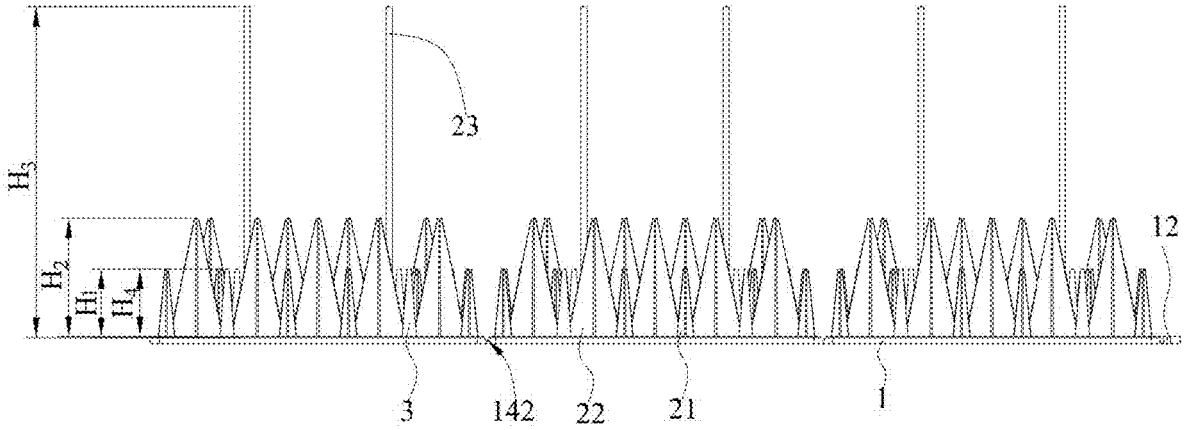
FIG. 2 is a front view of FIG. 1.
Figure 3:
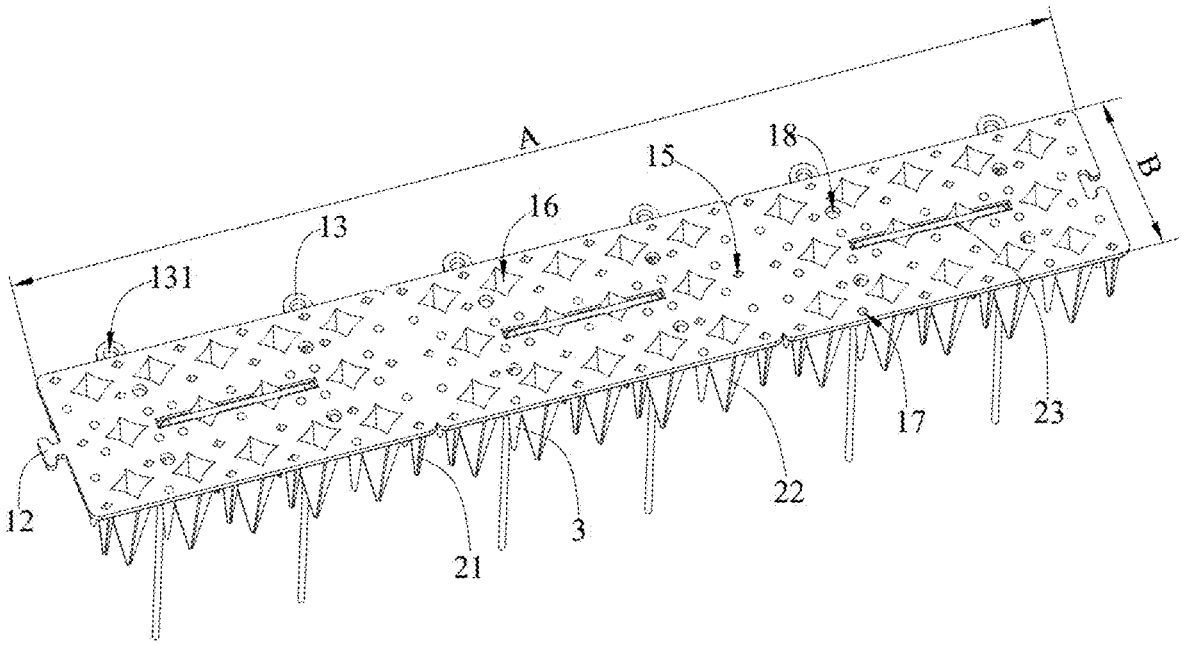
FIG. 3 is an overall schematic structural view of a deterrent mat with spikes according to another embodiment of the present disclosure.
Figure 4:
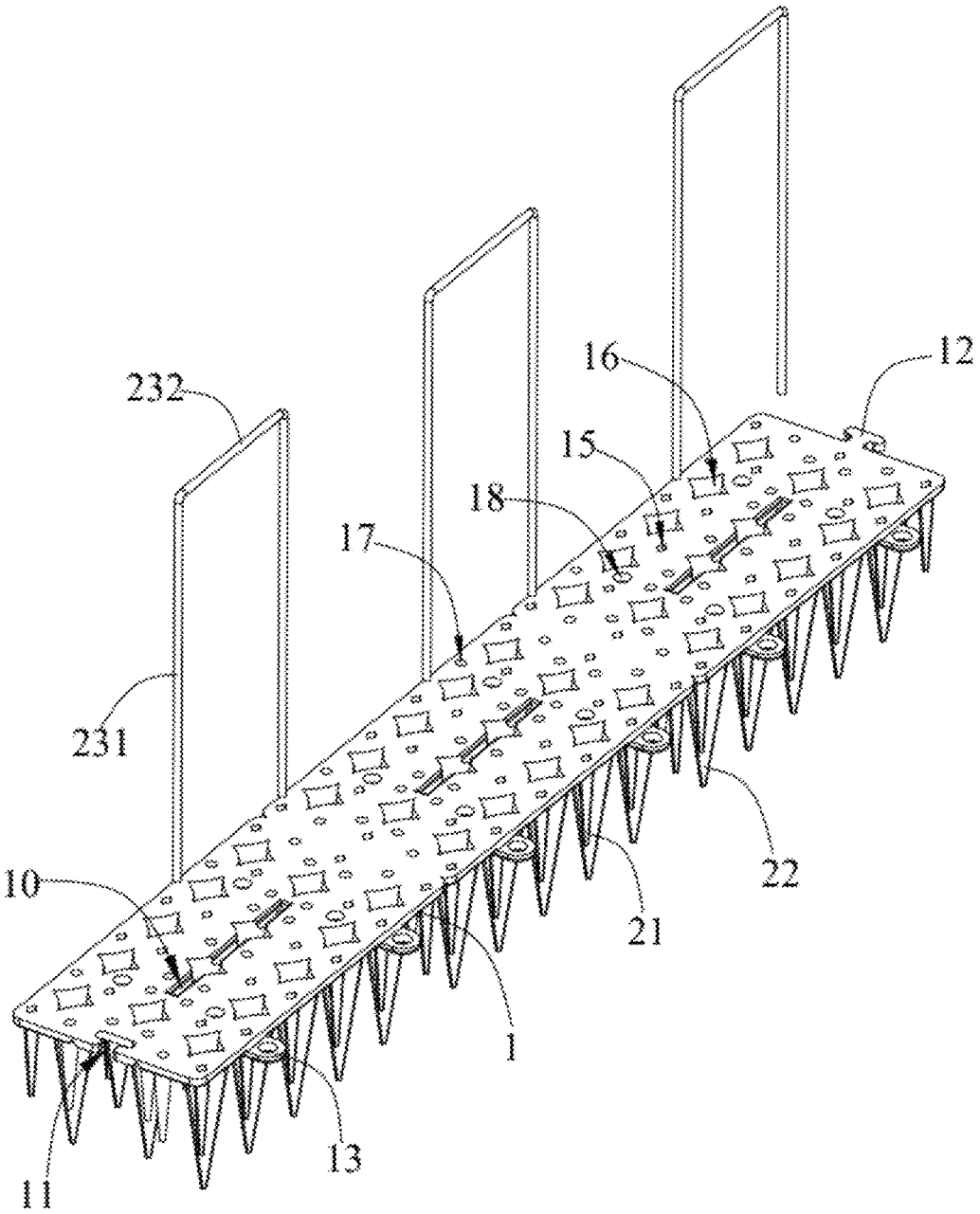
FIG. 4 is an exploded view of a deterrent mat with spikes according to an embodiment of the present disclosure.

The present disclosure will be described in detail below with reference to the accompanying drawings and in conjunction with various embodiments. Each example is provided to explain but not limit the present disclosure. In fact, it will be clear to those of ordinary skill that modifications and variations may be made without departing from the scope or spirit of the present disclosure. For example, a feature shown or described as part of one embodiment may be used according to another embodiment to produce yet another embodiment. Therefore, it is intended that the present disclosure includes such modifications and variations within the scope of the appended claims and their equivalents.

In the description of the present disclosure, the terms "longitudinal", "lateral", "upper", "lower", "front", "back", "left", "right", "vertical", "horizontal", "top", "bottom" and the like indicate the orientational or positional relationship based on the orientational or positional relationship illustrated in the drawings, which is only for the convenience of describing and does not require the present disclosure to be constructed and operated in a specific orientation, and therefore cannot be understood as limiting the present disclosure. The terms "connected", "connecting" and "arranged" used in the present disclosure should be understood in a broad sense. For example, it may be a fixed connection or a detachable connection; it may be directly connected or indirectly connected through an intermediate component; it may also be a wired electrical connection, a radio connection, or a wireless signal connection. For those of ordinary skill in the art, the specific meanings of the above terms may be understood according to the specific circumstances.

One or more examples of the present disclosure are illustrated in the attached drawings. Numbers and letter signs are used in the detailed description to refer to features in the drawings. Similar signs in the drawings and descriptions have been configured to refer to similar parts of the present disclosure. As used herein, the terms "first", "second" and "third" are used interchangeably to distinguish one component from another and are not intended to indicate the position or importance of individual components.

Please refer to FIG. 1, an embodiment of the present disclosure provides a deterrent mat with spikes, which is easy to assemble. It is mainly configured to prevent animals (birds, mice, etc.) from entering the courtyard, climbing over buildings, or staying on places such as fences. The basic principle is to make the animals feel uncomfortable when they land, climb or nest on the spikes, thereby achieving the deterrent purpose.

Please refer to FIG. 1 to FIG. 4, in one embodiment, the deterrent mat with spikes includes a base 1 and a spike assembly 2. Specifically, one end of the spike assembly 2 is connected to the base 1, and another end extends to a direction away from the base 1. The spike assembly 2 at least includes a plurality of first deterrent spikes 21 and a plurality of second deterrent spikes 22. The first deterrent spikes 21 and the second deterrent spikes 22 are arranged on a same side, a height $H_1$ of the first deterrent spikes 21 is less than a height $H_2$ of the second deterrent spikes 22, and the first deterrent spikes 21 and the second deterrent spikes 22 are arranged in an alternating manner.

The spike assembly 2 arranged in this way has two heights. Compared with the spike assembly 2 with only one height, it may increase the discomfort of the animals during their climbing and staying process, thereby improving deterrent effects.

It should be noted that, in the present embodiment, the first deterrent spikes 21 and the second deterrent spikes 22 may be collectively referred to as deterrent spikes. One deterrent spike has a root and an end portion. The root refers to one end of one deterrent spike connected to the base 1, and the end portion refers to one end of one deterrent spike away from the base 1 (i.e., the tip). The plane where the end portions (i.e., the tip) of the deterrent spikes with the same height are located is the deterrent surface. Obviously, the height H of the same height or different heights refers to a distance from the root to the end portion of one deterrent spike. The deterrent height refers to a distance from the deterrent surface to the base.

In one embodiment, a cross-sectional area of each first deterrent spike 21 gradually decreases in an extension direction of the spike assembly 2.

In another embodiment, the cross-sectional area of each second deterrent spike 22 gradually decreases in an extension direction of the spike assembly 2.

It should be noted that the first deterrent spikes 21 and the second deterrent spikes 22 arranged in this way have their ends formed with tips and their side walls evenly transitioned, making their structure more stable.

As illustrated in FIG. 1 to FIG. 4, in one embodiment, the spike assembly 2 also includes a third deterrent nail 23. A height $H_3$ of the third deterrent nail 23 is greater than the height $H_2$ of the second deterrent spike 22. The third deterrent nails 23 is detachably assembled with the base 1, and a user may choose to add the third deterrent nail 23 as needed.

In one embodiment, the height $H_1$ of the first deterrent spikes 21 is between 1.5 cm and 2.5 cm. The height $H_2$ of the second deterrent spikes 22 is between 3 cm and 5 cm. The height $H_3$ of the third deterrent nails 23 is between 8 cm and 12 cm.

In the present embodiment, the height $H_1$ of the first deterrent spikes 21 is 2 cm. The height $H_2$ of the second deterrent spikes 22 is 3.5 cm. The height $H_3$ of the third deterrent nails 23 is 10 cm. In other embodiments, the height $H_1$ of the first deterrent spikes 21 may also be 1.5 cm, 1.8 cm, 2.3 cm, 2.5 cm, etc.; the height $H_2$ of the second deterrent spikes 22 may also be 3 cm, 4 cm, 4.5 cm, 5 cm, etc.; the height $H_3$ of the third deterrent nails 23 may also be 8 cm, 9 cm, 11 cm, 12 cm, etc., as long as $H1<H2<H3$ is satisfied.

In one embodiment, the third deterrent nails 23 includes a nailing portion 231 and a connecting portion 232. At least one nailing portion 231 is provided, and the nailing portion 231 may pass through the base 1 and extend to a direction away from the base 1. The connecting portion 232 is connected to the nailing portion 231, and the connecting portion 232 is configured to engage with the base 1, thereby realizing the assembly between the base 1 and the third deterrent nail 23.

It should be noted that in the present embodiment, the third deterrent nail 23 includes two nailing portions 231 and one connecting portion 232. Two ends of the connecting portion 232 are respectively connected to the two nailing portions 231, so that the third deterrent nail 23 is U-shaped. A bottom surface of the base 1 is defined with a receiving groove 10, and the receiving groove 10 is configured to accommodate the connecting portion 232. Two ends of the receiving groove 10 are defined with holes for the two nailing portions 231 to pass through.

In the present embodiment, three third deterrent nails 23 are detachably assembled on the deterrent mat with spikes. In other embodiments, the third deterrent nails 23 may also be provided with only one nailing portion 231 and one connecting portion 232, and the nailing portion 231 is connected to the connecting portion 232, so that the third deterrent nail 23 is L-shaped.

Please continue to refer to FIG. 1 to FIG. 4, in one embodiment, one end of the base 1 is defined with a locking interface 11, and a locking head 12 is provided on a side wall of the base 1 away from the locking interface 11. The locking head 12 is configured to engage with the locking interface 11, thereby extending a length A or a width B of the deterrent mat with spikes. It should be noted that the length A of the deterrent mat with spikes is a length of a side parallel to an X-axis, and the width B is a width of a side parallel to a Y-axis.

In the present embodiment, the base 1 is a cuboid, and the locking interface 11 and the locking head 12 are respectively provided on the left and right sides of the base 1 (i.e., the sides parallel to the width direction). The locking interface 11 is a T-slot, the locking head 12 is a T-block adapted to the T-slot, and the T-block is integrally formed with the base. In this way, the length A of the deterrent mat with spikes may be extended by the engagement of the locking head 12 with the locking interface 11. In other embodiments, the locking interface 11 may also be arranged as a dovetail groove, and the locking head 12 is a trapezoidal block adapted to the dovetail groove.

In one embodiment, the locking interface 11 and the locking head 12 may be respectively arranged on front and rear sides of the base (i.e., the sides parallel to the longitudinal direction). In this way, the width B of the deterrent mat with spikes may be extended by the engagement of the locking head 12 with the locking interface 11.

In one embodiment, a plug-in column 3 is also provided on the base 1, and a plug-in portion 13 is protruded from one side wall of the base 1, and plug-in portion 13 is defined with a plug-in hole 131. The plug-in hole 131 is configured to assemble with the plug-in column 3 to connect one base 1 with another base 1, thereby extending the length A or the width B of the deterrent mat with spikes.

In the present embodiment, the plug-in portion 13 is arranged on a side parallel to the longitudinal direction. There are multiple plug-in portions 13, the multiple plug-in portions 13 are arranged at equal intervals along the X-axis direction. The multiple plug-in portions 13 are all defined with plug-in holes 131. One end of the plug-in column 3 is connected to the base 1, and another end extends along the extension direction of the spike assembly 2. There are multiple plug-in columns 3. When two adjacent deterrent mats with spikes are connected, the plug-in columns 3 may engage with the plug-in holes 131 to expand the width B of the deterrent mat with spikes.

In one embodiment, the plug-in portions 13 may be arranged on a side parallel to the width direction. In this way, the length A of the deterrent mat with spikes may be extended by the engagement of the plug-in columns 3 with the plug-in holes 131.

In one embodiment, the plug-in columns 3 are arranged on a same side as the first deterrent spikes 21, and a height $H_4$ of the plug-in columns 3 is the same as the height $H_1$ of the first deterrent spikes 21. In this way, the overall structure of the deterrent mat with spikes may be simplified. In other embodiments, the height $H_4$ of the plug-in columns 3 is greater than the height $H_1$ of the first deterrent spikes 21, or the height $H_4$ of the plug-in column 3 is less than the height $H_1$ of the first deterrent spikes 21. The selection may be made according to the user's needs, so long as the plug-in columns 3 is able to be adapted to the plug-in holes 131.

As illustrated in FIG. 1 to FIG. 4, in one embodiment, one end surface of the base 1 with the first deterrent spikes 21 and the second deterrent spikes 22 is defined with a groove for bending 14. The base 1 may be bent through the groove for bending 14, so that the deterrent mat with spikes may be used on non-planar surfaces of some buildings.

In one embodiment, the groove for bending 14 includes a first groove for bending 141 and a second groove for bending 142. The first groove for bending 141 extends along the longitudinal direction of the base 1, so that the base 1 may be bent in the width direction. The second groove for bending 142 extends along the width direction of the base, so that the base 1 may be bent in the longitudinal direction. In the present embodiment, the first groove for bending 141 and the second groove for bending 142 are both V-shaped grooves.

In one embodiment, a bottom surface of the base 1 is defined with a first blind hole 15, a second blind hole 16 and a third blind hole 17. The first blind hole 15 penetrates the base 1 and extends into the first deterrent spike. The second blind hole 16 penetrates the base 1 and extends into the second deterrent spike. The third blind hole 17 penetrates the base 1 and extends into the plug-in column 3.

It should be noted that a plurality of first blind holes 15, a plurality of second blind holes 16, and a plurality of third blind holes 17 are provided. Each first deterrent spike 21 corresponds to a first blind hole 15, each second deterrent spike 22 corresponds to a second blind hole 16, and each plug-in column 3 corresponds to a third blind hole 17. During transportation or storage, the first deterrent spikes 21 may be inserted into the first blind holes 15 of another deterrent mat with spikes, the second deterrent spikes 22 may be inserted into the second blind holes 16 of another deterrent mat with spikes, and the plug-in column 3 may be inserted into the third blind hole of another deterrent spikes. It may be seen that the arrangement of the first blind holes 15, the second blind holes 16 and the third blind holes 17 may not only effectively reduce the material used for the deterrent mat with spikes and reduce the manufacturing cost, but also facilitate stacking, which is conducive to packaging and storage.

In one embodiment, the bottom surface of the base 1 is defined with a plurality of through holes 18. Each of the through hole 18 is configured for inserting an external fastener to fix the deterrent mat with spikes to outdoor buildings.

Compared with the related art, the deterrent mat with spikes of the present disclosure has the following effects.

1) By providing the first deterrent spikes 21 and the second deterrent spikes 22 of different heights, and the first deterrent spikes 21 and the second deterrent spikes 22 are arranged in an alternating manner. The spike assembly 2 has two deterrent heights. Compared with the spike assembly 2 with only one deterrent height, it may increase the discomfort of the animals during their climbing process staying process, thereby improving deterrent effects.
2) By providing the locking interface 11 and the locking head 12, the adjacent deterrent mat with spikes are connected to each other in the longitudinal or width direction, and the adjacent deterrent mat with spikes are connected to each other in the width or longitudinal direction by the engagement of the plug-in column 3 with the plug-in portion 13. In this way, the deterrent mat with spikes may be used with the extended length A or width B, so that the user may freely assemble the deterrent mat with spikes as required, which improves the applicability and diversity of the deterrent mat with spikes.
3) The third deterrent nail 23 is detachably assembled with the base 1, so that the user may install or remove the third deterrent nail 23 according to different needs. Such a way may provide various usage methods for the deterrent mat with spikes, further improving the application diversity of the deterrent mat with spikes. By arranging the third deterrent nails 23, the deterrent mat with spikes has three deterrent heights, further improving the deterrent effects of the deterrent mat with spikes.
4) The arrangement of the first groove for bending 141 and the second groove for bending 142 enables the deterrent mat with spikes to be bent in the width and longitudinal direction, thus adapting to non-planar surfaces of some buildings. Therefore, the deterrent mat with spikes may be used on places with non-planar surfaces, and the application scenarios of the deterrent mat with spikes is expanded.
5) The arrangement of the first blind hole 15, the second blind hole 16 and the third blind hole 17 may not only effectively reduce the material used for the deterrent mat with spikes and reduce the manufacturing cost, but also facilitate stacking, which is conducive to packaging and storage.

The above description is only some embodiments of the present disclosure and is not intended to limit the present disclosure. For those of ordinary skill in the art, the present disclosure may have various modifications and variations. Any modification, equivalent replacement, improvement, etc. made within the spirit and principle of the present disclosure shall be included in the protection scope of the present disclosure.

The invention claimed is:

1. A deterrent mat with spikes, comprising:

a base; and a spike assembly, wherein one end of the spike assembly is connected to the base and another end extends to a direction away from the base, the spike assembly at least comprises a plurality of first deterrent spikes and a plurality of second deterrent spikes, the plurality of first deterrent spikes and the plurality of second deterrent spikes are arranged on a same side, a height of the plurality of first deterrent spikes is less than that of the plurality of second deterrent spikes, and the plurality of first deterrent spikes and the plurality of second deterrent spikes are arranged alternately.

2. The deterrent mat with spikes according to claim 1, wherein the spike assembly also comprises a third deterrent nail, and a height of the third deterrent nail is greater than that of the second deterrent spike.

3. The deterrent mat with spikes according to claim 2, wherein the height of the third deterrent nails ranges from 8 cm to 12 cm.

4. The deterrent mat with spikes according to claim 2, wherein the third deterrent nail is detachably assembled with the base.

5. The deterrent mat with spikes according to claim 4, wherein the base is defined with a receiving groove, and an inner wall of the receiving groove is defined with a hole, and the third deterrent nail comprises:

a nailing portion, wherein at least one nailing portion is provided, the nailing portion penetrates the hole and extends to the direction away from the base; and a connecting portion, connected to the nailing portion, wherein the connecting portion is assembled in the receiving groove in a detachable manner.

6. The deterrent mat with spikes according to claim 5, wherein two nailing portions are provided, the two nailing portions are respectively connected to two ends of the connecting portion, and the third deterrent nail is U-shaped.

7. The deterrent mat with spikes according to claim 1, wherein one end of the base is defined with a locking interface, a side wall of the base away from the locking interface is provided with a locking head, and the locking head is adapted to the locking interface to expand a length or a width of the deterrent mat with spikes.

8. The deterrent mat with spikes according to claim 1, wherein one end surface of the base with the first deterrent spikes and the second deterrent spikes is defined with a groove for bending, and the base is bendable along the groove for bending;

the groove for bending comprises a first groove for bending and a second groove for bending; the first groove for bending extends along a longitudinal direction of the base, and the second groove for bending extends along a width direction of the base.

9. The deterrent mat with spikes according to claim 1, wherein the height of the plurality of first deterrent spikes ranges from 1.5 cm to 2.5 cm; and the height of the plurality of second deterrent spikes ranges from 3 cm to 5 cm.

10. The deterrent mat with spikes according to claim 1, a bottom surface of the base is defined with a plurality of through holes, each of the plurality of through holes is configured for inserting an external fastener to fix the deterrent mat with spikes to an outdoor building.

11. The deterrent mat with spikes according to claim 1, wherein the base is provided with a plug-in column, a plug-in part is protruded from one side wall of the base, the plug-in part is defined with a plug-in hole, and the plug-in hole is configured to engage with the plug-in column to connect one base with another base to expand the length or the width of the deterrent mat with spikes; and the plug-in column is provided on a same side as the first deterrent spikes, and the plug-in column has a same height as the first deterrent spikes.

12. The deterrent mat with spikes according to claim 11, wherein a bottom surface of the base is defined with a first blind hole, a second blind hole and a third blind hole, the first blind hole penetrates the base and extends into the first deterrent spike, the second blind hole penetrates the base and extends into the second deterrent spike, and the third blind hole penetrates the base and extends into the plug-in column.

13. The deterrent mat with spikes according to claim 12, a plurality of second blind holes 16 and a plurality of third blind holes are provided.

14. The deterrent mat with spikes according to claim 13, each first deterrent spike corresponds to a first blind hole, each second deterrent spike corresponds to a second blind hole, and each plug-in column corresponds to a third blind hole.

* * * * *